United States Patent [19]

Falendysz, Sr. et al.

[11] 4,388,052

[45] Jun. 14, 1983

[54] FIXED DISPLACEMENT PUMP WITH VARIABLE CAPACITANCE FLOW REGULATOR

[75] Inventors: Eugene L. Falendysz, Sr.; Eldon M. Brumbaugh; Max R. North, all of Racine, Wis.

[73] Assignee: J. I. Case Company, Racine, Wis.

[21] Appl. No.: 247,667

[22] Filed: Mar. 26, 1981

[51] Int. Cl.[3] ..... F04B 39/00; F04B 23/00; F16L 55/04

[52] U.S. Cl. ..... 417/540; 138/30; 138/31; 60/469; 92/13.3

[58] Field of Search ..... 138/30, 31; 60/469; 417/540

[56] References Cited

U.S. PATENT DOCUMENTS

| | | | |
|---|---|---|---|
| 3,230,977 | 1/1966 | Mercier | 138/31 |
| 3,362,346 | 1/1968 | Bottoms | 417/540 |
| 3,487,855 | 1/1970 | Lautenberger | 138/31 |
| 3,906,839 | 9/1975 | Schexnayder | 138/31 |
| 3,985,063 | 10/1976 | Lemon | 138/31 |
| 4,000,758 | 1/1977 | Meisenheimer | 138/31 |
| 4,138,846 | 2/1979 | Sakakibara | 138/31 |
| 4,201,522 | 5/1980 | Toyota | 417/311 |

*Primary Examiner*—William L. Freeh
*Assistant Examiner*—Jane Obee
*Attorney, Agent, or Firm*—Cullen, Sloman, Cantor, Grauer, Scott & Rutherford

[57] ABSTRACT

A fixed displacement pump including a variable capacitance flow regulator for absorbing the excess fluid flow from the pump which is not required by a hydraulic system. The variable capacitance flow regulator, in a hydraulic embodiment, includes a pair of pistons slidably movable within a housing for independent movement relative to each other. The fluid pressure in the hydraulic system is communicated to a first of the pistons to bias it to various positions within the housing depending upon the pressure level in the hydraulic system. The second or varibale capacitance piston is acted upon by the fluid pressure in the pump discharge chamber, and when the pressure in the hydraulic system exceeds the spring pre-load against the first piston, the first piston will be displaced away from the second piston. This will permit the second piston to move toward and away from the first piston in response to fluid pressure against it from the pump discharge chamber, thereby absorbing the fluid displacement from the pump. In a mechanical embodiment, the present invention includes a fixed displacement pump piston connected to a variable capacitance piston by a rocker arm that is pivotal about a movable pivot point. The movable pivot point is positioned in response to pressure in the hydraulic system or in response to a control signal that is generated by a control device such as a centrifugal governor or speed control mechanism. Movement of the rocker arm pivot point permits the variable capacitance piston to absorb the pump piston output thereby reducing output flow from the pump until the absorption volume of the variable capacitance piston substantially equals the pump piston output volume.

3 Claims, 3 Drawing Figures

FIXED DISPLACEMENT PUMP WITH VARIABLE CAPACITANCE FLOW REGULATOR

BACKGROUND OF THE INVENTION

The present invention relates to an improved fixed displacement pump arrangement for satisfying the requirements of a hydraulic system while requiring less power to operate during low demand conditions, and more particularly, to a variable capacitance flow regulator which absorbs excess fluid volume when the full volume of fluid displacement from the pump is not required by the hydraulic system.

It is common in earth-moving equipment, such as front end loaders, backhoes or the like, to have a bucket or a shovel mounted on a tractor to be raised and lowered, tilted, or otherwise moved into the correct attitude by an appropriate mechanism for the work being performed at the moment. Such adjustments of the bucket or shovel are commonly made by hydraulic cylinders supplied with pressure fluid from a suitable pump.

A common mode of operation in earth-working is to move a bucket or shovel into a pile of material. The hydraulic systems for such earth-working applications require a high volume of fluid at low pressure to rapidly move the cylinder piston rods and, therefore, the bucket or shovel to the work. Then, low fluid volume under high pressure must be available to provide the necessary tilting of the bucket or shovel to break a portion of the material loose from the work pile or lift the material in the bucket or shovel.

One of the prior art approaches has been to provide a fixed displacement pump to supply the required fluid under pressure with the excess being discharged through a relief valve. It is a common arrangement to use the tractor engine for driving the pump, and the pump is normally continuously delivering its maximum amount of fluid because the tractor engine runs at a governed speed. Much of the time, the full volume of fluid is not required, and the excess fluid power must be absorbed by the system in the form of undesired heating of the pressure fluid and wear on the relief valve.

Another prior art approach has been to utilize a variable displacement pump in connection with automatic controls so that the output of the pump can be maintained at a minimum except when further output is demanded by the system. A system so equipped demands less power to operate the hydraulic system, reduces the heat rise in the fluid when operating in a low demand condition, permits a possible reduction in capacity of an oil cooler, and reduces pump and relief valve noise under low demand conditions.

A major disadvantage to the use of a variable displacement pump is cost. A variable displacement pump is significantly more expensive than a comparable fixed displacement pump, increasing the overall expense of manufacturing earth-working machines such as backhoes and front-end loaders.

Thus, there has been a need for an improved fixed displacement pump arrangement which is capable of absorbing excess fluid volume during low demand operation, thereby requiring less power to operate while being less expensive than a comparable variable displacement pump.

SUMMARY OF THE INVENTION

The fixed displacement pump arrangement of the present invention may be used with conventional earth-working equipment including front-end loaders and backhoes. The pump arrangement is intended to satisfy the demands of a hydraulic system such as used in front-end loaders and backhoes wherein a high volume of fluid is required at low pressure for rapid traverse up to the work and then low volume, high pressure fluid is required for clamping, feeding or pressing. It is understood that the pump arrangement of the present invention may be used in other environments having similar requirements.

A hydraulic system equipped with the pump arrangement of the present invention demands less power to operate and aids in the reduction of heat rise in the fluid during low demand operation.

The fixed displacement pump, in a first embodiment, includes a variable capacitance flow regulator connected to the fluid discharge chamber of the pump for absorbing the excess fluid flow from the pump which is not required by the hydraulic system. A fixed displacement pump equipped with the variable capacitance flow regulator of the present invention performs like a variable displacement pump in that it requires less power to operate during low demand conditions.

In the first embodiment, the variable capacitance flow regulator includes a pair of pistons slidably movable within a housing for independent movement relative to each other. The fluid pressure in the hydraulic system is communicated to a first of the pistons to bias it against a spring mechanism to various positions within the housing depending upon the pressure level in the hydraulic system.

The second or variable capacitance piston is independently movable within the housing relative to the first piston, and it is acted upon at one end by a spring mechanism that is located between the first and second pistons. The other end of the second piston is acted upon by the fluid pressure in the pump discharge chamber.

If the pressure level in the hydraulic system is below that necessary to reduce flow, the full displacement from the pump passes through the pump discharge chamber and through a check valve into the hydraulic system for utilization as required. Under these circumstances, the pistons of the variable capacitance flow regulator are at rest and in contact with one another.

When the pressure in the hydraulic system, which is communicated to the first piston, exceeds the spring pre-load against the first piston, the first piston will be displaced away from the second piston against its spring mechanism. This will permit the second piston to move toward the first piston in response to fluid pressure against it from the pump discharge chamber, thereby absorbing the fluid displacement from the pump. The second piston will be displaced until it again contacts the first piston and then, the fluid pressure in the pump discharge chamber increases thereby forcing fluid through the check valve into the hydraulic system.

As the pump begins its intake stroke, the second piston moves away from the first piston and returns to its at rest position due to the force of the spring between the pistons, atmospheric pressure, and the suction effect from the pump. The first piston will not return to its rest position, however, until the pressure in the hydraulic system is reduced. As the pressure in the hydraulic system increases, the displacement or travel of the second piston increases until its displacement substantially equals that of the pump, and the fluid flow into the hydraulic system is then only that amount required to maintain pressure in the hydraulic system.

As described, the fluid pressure in the hydraulic system acts as a control signal for moving the first piston to various positions within the housing. It is within the scope of the present invention to provide other devices for generating the control signal required for positioning the first piston including, but not limited to, centrifugal governors or speed control mechanisms.

The present invention, in a second embodiment, includes a fixed displacement pump piston connected to a variable capacitance piston by a rocker arm that is pivotal about a movable pivot point. The movable pivot point is positioned in response to pressure in the hydraulic system or in response to a control signal that is generated by a control device such as a centrifugal governor or speed control mechanism. Movement of the rocker arm pivot point permits the variable capacitance piston to absorb the pump piston output thereby reducing output flow from the pump until the absorption volume of the variable capacitance piston substantially equals the pump piston output volume.

Other advantages and meritorious features of the fixed displacement pump arrangement of the present invention will be more fully understood from the following detailed description of the invention, the appended claims, and the drawings, a brief description of which follows.

DETAILED DESCRIPTION OF THE INVENTION

Figure 1:
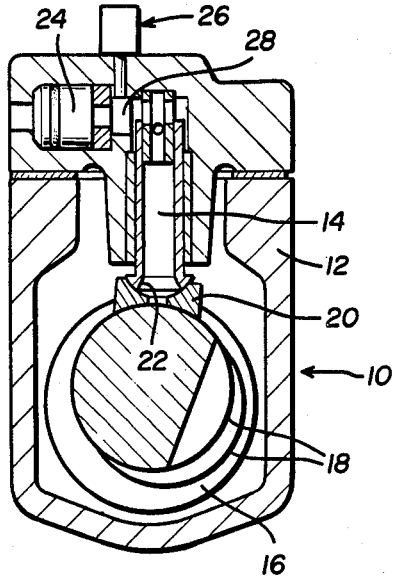
FIG. 1 is a side elevational view, partially in cross-section, of a fixed displacement pump including one embodiment of the variable capacitance flow regulator of the present invention.
Figure 2:
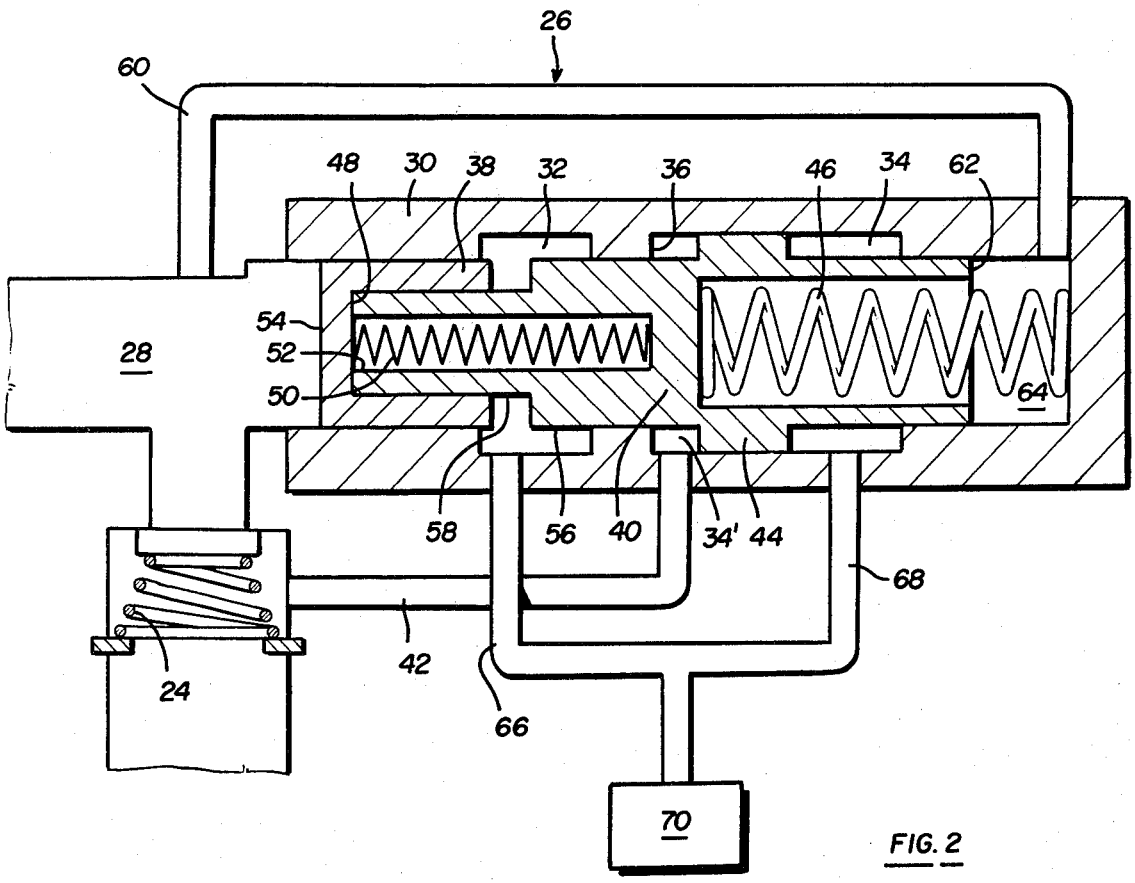
FIG. 2 is a schematic illustration of a first embodiment of the variable capacitance flow regulator of the present invention.

A first or hydraulic embodiment of a fixed displacement pump having a variable capacitance flow regulator made in accordance with the teachings of the present invention is illustrated in FIGS. 1–2.

The fixed displacement hydraulic pump 10 illustrated in FIG. 1 is a "PS" series pump manufactured and sold by Poclain Hydraulics, and its includes a housing 12 with one or more lines of reciprocable pistons 14 mounted radially around a crankshaft 16. Crankshaft 16 includes a number of cam lobes or crank pins 18, and each piston 14 is mounted on a respective crank pin by a free riding slipper 20. Each piston 14 includes an enlarged spherical end or head 22 with an axial drilling therethrough which allows fluid flow in through the piston head for filling the piston with fluid.

The hydraulic fluid is fed into the body housing 12, and the rotation of the crankshaft 16 and design of the cam lobes 18 provides a flow path for fluid which causes filling of piston 14. As piston 14 reciprocates, fluid under pressure is discharged through check valve 24 to a conventional hydraulic circuit (not shown) such as used in earth-working equipment. Further details of the construction or operation of the fixed displacement pump 10 are unnecessary since alone they form no part of the present invention.

The variable capacitance flow regulator 26 of the present invention is connected to the fluid discharge chamber 28 of pump 10 for absorbing the excess fluid flow from pump 10 which is not required by the hydraulic circuit. Variable capacitance flow regulator 26 includes a housing 30 having interior fluid chambers 32 and 34 separated by an annular projection 36. A pair of pistons 38 and 40 are slidably movable within housing 30 for independent movement relative to each other.

Fluid pressure from the hydraulic circuit downstream of check valve 24 is communicated by conduit 42 into housing chamber 34' to act upon the enlarged annular portion 44 of piston 40. This causes piston 40 to be selectively displaced against spring 46 to various positions within housing 30 depending upon the pressure level in the hydraulic circuit. Thus, the fluid pressure in the hydraulic circuit acts as a control signal for moving piston 40 to various positions within housing 30.

It is within the scope of the present invention to provide devices for generating the control signal required for positioning piston 40, other than fluid pressure through conduit 42. For example, a centrifugal governor or speed control device may be connected to piston 40 through appropriate linkage for causing piston 40 to move in response to a control signal generated by the control device.

Variable capacitance piston 38 is independently movable within housing 30 relative to piston 40 to permit absorption of the excess fluid from pump 10 which is not required by the hydraulic circuit. One end 48 of piston 38 is acted upon by spring 50 which is mounted between pistons 38 and 40 in piston opening 52. The other end 54 of piston 38 is acted upon by the fluid pressure in pump discharge chamber 28.

Piston 40 includes a unique design of three concentric annular portions 44, 56, and 58, each serving a different purpose. As described, fluid pressure from the hydraulic circuit acts upon a first of these annular portions 44 for causing piston 40 to be displaced against spring 46. A second of the annular portions 56 sealingly engages annular projection 36 in housing 30 during the displacement of piston 40 to separate fluid in housing chamber 34' from fluid in chamber 32. Further, annular portion 58 includes an opening 52 for mounting spring 50 in a position between pistons 38 and 40. Annular portion 58 is also telescopically received within cup-shaped piston 38 when the pistons 38 and 40 are in contact as shown in FIG. 2.

A fluid conduit 60 provides fluid communication between pump discharge chamber 28 and the end 62 of piston 40 in chamber 64 such that the displacement of piston 40 is not affected by the pressure in chamber 28. That is, the area of piston 40 at end 62 equals the area of piston 38 at end 54 so that the pressure in fluid discharge chamber 28 has no resultant effect on piston 40. Fluid chambers 32 and 34 also include low pressure return conduits 66 and 68 connected to reservoir 70 for equalization purposes.

As the pump crankshaft 16 rotates, pump piston 14 is reciprocated to generate fluid pressure in discharge chamber 28. If the pressure level in the hydraulic circuit downstream of check valve 24 is below that necessary to reduce flow, the full displacement from pump 10 passes through check valve 24 into the hydraulic system for utilization as required. Under these circumstances, pistons 38 and 40 are at rest and in contact with one another as illustrated in the FIG. 2.

When the pressure in the hydraulic circuit, which is communicated as a control signal to piston 40 through conduit 42, exceeds the pre-load of spring 46 against piston 40, piston 40 will be displaced within housing 30 against spring 46 and away from variable capacitance piston 38. This will permit variable capacitance piston 38 to move toward piston 40 in response to the fluid pressure against it from the pump discharge chamber 28 thereby absorbing the fluid displacement from the pump. Piston 38 will be displaced until it again contacts piston 40 and then, the fluid pressure in pump discharge chamber 28 increases thereby forcing fluid through check valve 24 into the hydraulic circuit.

As pump 10 begins its intake stroke, piston 38 moves away from displaced piston 40 and returns to its at rest position due to the force of spring 50, atmospheric pressure in chamber 32, and the suction effect from the pump. Piston 40 will not return to the rest position of FIG. 2, however, until the pressure in the hydraulic circuit is reduced. As the pressure in the hydraulic circuit increases, the displacement or travel of piston 38 towards and away from piston 40 increases until its displacement substantially equals that of pump piston 14, and the fluid flow into the hydraulic circuit is then only that amount required to maintain pressure in the hydraulic circuit.

Figure 3:
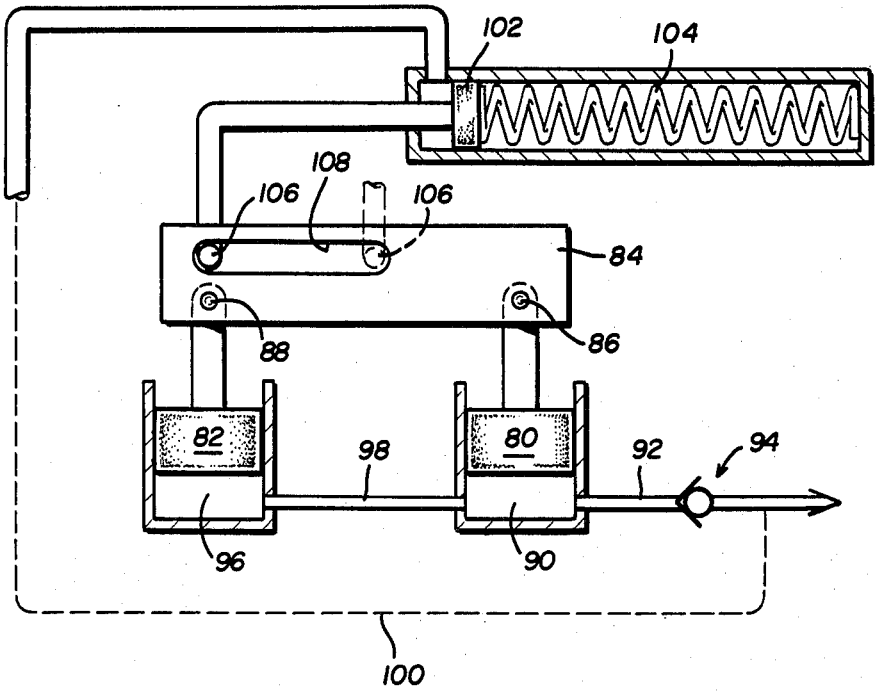
FIG. 3 is a schematic illustration of a second embodiment of the variable capacitance flow regulator having a different actuating mechanism for the variable capacitance piston.

FIG. 3 is an illustration of a second embodiment of the variable capacitance flow regulator of the present invention for absorbing excess fluid flow from a fixed displacement pump and having a different actuating mechanism for the variable capacitance piston. In this arrangement, the fixed displacement pump piston 80 is connected to variable capacitance piston 82 by rocker arm 84 at pivot points 86 and 88. A fluid conduit 92 and check valve 94 provide fluid communication between pump discharge chamber 90 and a hydraulic circuit (not shown). Similarly, a fluid conduit 98 provides fluid communication between pump discharge chamber 90 and variable capacitance piston chamber 96.

Fluid pressure from the hydraulic circuit downstream of check valve 94 is communicated by conduit 100 to act upon piston 102. This causes piston 102 to be selectively displaced against spring 104 to various positions depending upon the pressure level in the hydraulic circuit.

Rocker arm 84 pivots about the rod end 106 of piston 102 which acts as a movable pivot point. The movable pivot point 106 is moved to various positions within rocker arm slot 108, between the extreme solid and phantom line positions illistrated, in response to pressure changes in the hydraulic circuit. In the illustrated embodiment, the pressure in the hydraulic circuit acts as a control signal for the positioning of pivot point 106. Movable pivot point 106 may also be positioned by other control devices capable of generating a control signal such as a centrifugal governor or speed control mechanism.

If the pressure level in the hydraulic circuit downstream of check valve 94 is below that necessary to reduce flow, the rocker arm 84 pivots about point 106 at its solid line position shown in FIG. 3, thereby preventing displacement of variable capacitance piston 82. In this condition, the full displacement from pump piston 80 passes through check valve 94 into the hydraulic circuit for utilization as required.

When the pressure in conduit 100 from the hydraulic circuit exceeds the pre-load of spring 104 against piston 102, rocker arm pivot point 106 moves within slot 108 from the solid line position in FIG. 3 towards the phantom line position which permits displacement of variable capacitance piston 82. Thus, the variable capacitance piston 82 begins to absorb the output from pump piston 80 thereby reducing output flow. At the phantom line position of pivot point 106 in FIG. 3, the absorption volume of the variable capacitance piston 82 substantially equals the output volume from pump piston 80 which reduces the output flow from pump piston 80 to the hydraulic circuit to that amount required to maintain pressure in the hydraulic circuit.

It will be apparent to those skilled in the art that the foregoing disclosure is exemplary in nature, rather than limiting, the invention being limited only by the appended claims.

We claim:

1. In a fixed displacement fluid pump which is adapted for connection to a hydraulic circuit for supplying the fluid under pressure required by the hydraulic circuit and said pump having a fluid discharge chamber that is connected to said hydraulic circuit by a valve means, the improvement comprising:

a variable capacitance flow regulator connected to said fluid discharge chamber for absorbing the excess fluid flow from said pump which is not required by said hydraulic circuit, said variable capacitance flow regulator including a housing, a first piston slidably mounted within said housing for movement in response to variations in the fluid pressure in said hydraulic circuit and a first spring means mounted between one end of said housing and one end of said first piston, and means for communicating the fluid pressure from downstream of said valve means to said first piston for biasing said first piston against said first spring means to various positions within said housing depending upon the fluid pressure in said hydraulic circuit, a second variable capacitance piston slidably mounted within said housing for independent movement relative to said first piston and a second spring means mounted between said first and second pistons, means for communicating the fluid pressure from said pump discharge chamber aganist one end of said second piston for biasing it against said second spring means and means for communicating the fluid pressure from said pump discharge chamber to said one end of said first piston, and said second piston being movable toward and away from said first piston depending upon the fluid flow demands of said hydraulic circuit and the fluid flow in said pump discharge chamber, thereby absorbing the fluid displacement from said pump which is not required by said hydraulic circuit.

2. The fixed displacement pump as defined in claim 1 wherein said first piston includes a first annular portion that is acted upon by said fluid pressure from downstream of said valve means such that said first piston is biased against said first spring means to various positions within said housing depending upon the fluid pressure in said hydraulic circuit.

3. The fixed displacement pump as defined in claim 1 wherein said housing includes an interior annular projection, said first piston includes an annular portion which sealingly engages said housing annular projection and an annular portion for supporting said second spring means.

* * * * *